United States Patent [19]

Aubry et al.

[11] Patent Number: 4,594,947

[45] Date of Patent: Jun. 17, 1986

[54] APPARATUS FOR SHAPING A DETONATION WAVE

[75] Inventors: Julien Aubry, Pavillons/Bois; André Cachin, Nevilly, both of France

[73] Assignee: Commissariat a l'Energie Atomique, Paris, France

[21] Appl. No.: 632,546

[22] Filed: Jul. 19, 1984

[30] Foreign Application Priority Data

Jul. 28, 1983 [FR] France ..... 83 12481

[51] Int. Cl.[4] ..... F42B 1/02

[52] U.S. Cl. ..... 102/307; 102/309; 102/476

[58] Field of Search ..... 102/306, 307, 309, 476

[56] References Cited

U.S. PATENT DOCUMENTS

| | | | |
|---|---|---|---|
| 2,980,018 | 4/1961 | Turechek | 102/20 |
| 3,027,838 | 4/1962 | Meddick | 102/24 |
| 3,147,707 | 9/1964 | Caldwell | 102/309 |
| 3,292,536 | 12/1966 | Church et al. | 102/306 |
| 3,437,036 | 4/1969 | Franzen et al. | 102/306 X |
| 3,732,816 | 5/1973 | Müller | 102/306 |
| 3,736,875 | 6/1973 | Bucklishch | 102/309 |
| 3,802,342 | 4/1974 | Berlot et al. | 102/309 |
| 4,250,792 | 2/1981 | Deigmuller et al. | 102/309 X |

FOREIGN PATENT DOCUMENTS

| | | | |
|---|---|---|---|
| 1070536 | 12/1959 | Fed. Rep. of Germany | 102/306 |
| 2945478 | 5/1981 | Fed. Rep. of Germany . | |
| 2841040 | 9/1982 | Fed. Rep. of Germany . | |
| 1145210 | 12/1955 | France . | |
| 1183511 | 9/1957 | France . | |
| 1549158 | 3/1964 | France . | |
| 1444913 | 5/1965 | France . | |
| 1514556 | 3/1967 | France . | |
| 2522805 | 9/1979 | France | 102/307 |
| 677824 | 8/1952 | United Kingdom | 102/306 |
| 1604010 | 12/1981 | United Kingdom | 102/476 |

*Primary Examiner*—Peter A. Nelson

*Attorney, Agent, or Firm*—James E. Nilles

[57] ABSTRACT

Process and apparatus for shaping a detonation wave.

In a conventional manner, a priming explosive mass is separated from a charging explosive mass by a shield. According to the invention, use is made of a porous material for forming the shield and it is given a shape such that, in the charging explosive, the detonation wave from the priming explosive is always in front of the shock wave from the shield.

Application to the piercing of thick metal sheets.

11 Claims, 4 Drawing Figures

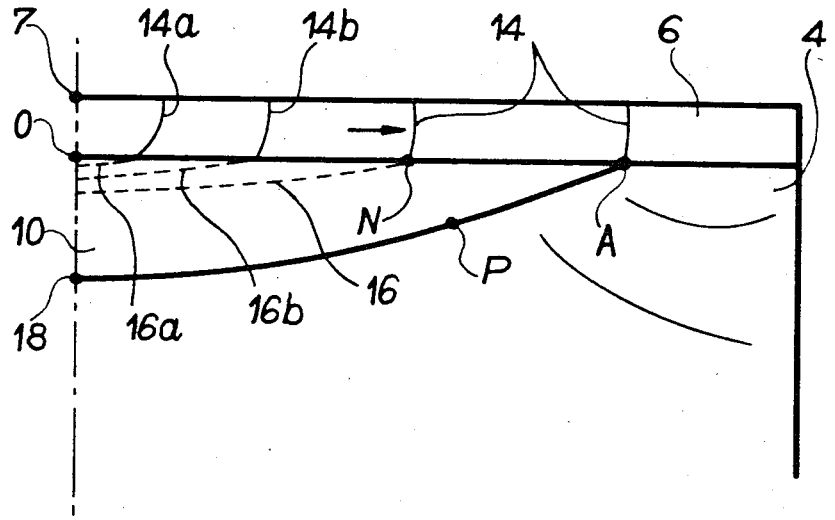
FIG. 3a
FIG. 3b
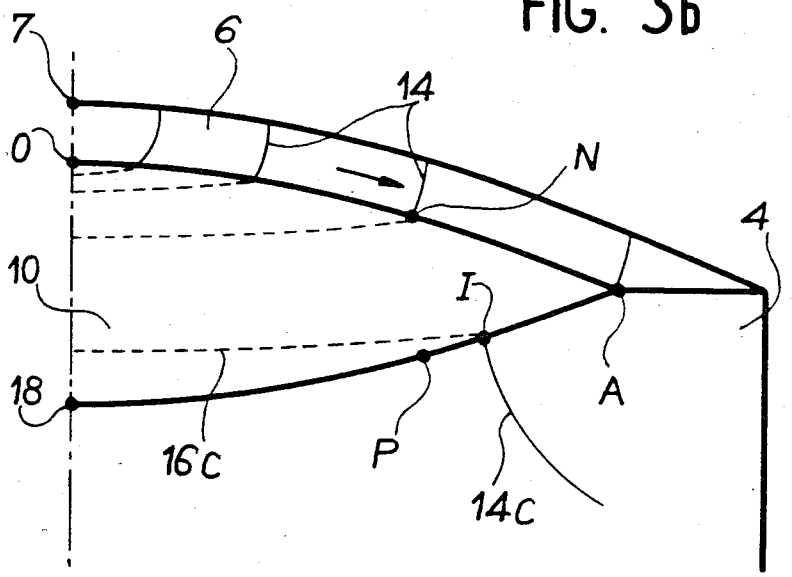

APPARATUS FOR SHAPING A DETONATION WAVE

BACKGROUND OF THE INVENTION

The present invention relates to a process and an apparatus for shaping a detonation wave, particularly but not exclusively applicable to hollow charges.

Shaped charges and particularly hollow charges are well known and are widely used in means for piercing or cutting e.g. a thick plate. In hollow charges, the explosive which is called the "useful" explosive and which moves the coating of the cavity is frequently initiated by a priming explosive block. If a shield is placed between these two components, a toroidal detonation wave is produced in the useful explosive, which improves the piercing performance levels of the charge.

Throughout the remainder of the present text the term "charging explosive" or "useful explosive" will be used to describe the explosive for moving the coating. The term "priming explosive" designates an explosive mass for transmitting to the useful explosive the detonation wave emitted by a detonator.

The shield makes it necessary for the detonation wave to pass round the latter so that it arrives frontally, in the vicinity of the top thereof, on the conical surface defining the hollowed out part of the charging explosive. It is known that this leads to an increase in the efficiency of the hollow charge.

However, conventional means suffer from the following disadvantage. The shield is almost always made from a compact material, which can be an organic material such as nylon, but other materials are also possible (metals, polymers, ceramics). However, the detonation wave transmitted by the priming explosive produces a shock wave in the shield, which is propagated in the latter at a very high velocity and is then transmitted to the interior of the charging explosive. Due to the very high velocity of the shock wave in the compact shield, the latter arrives at a given point of the charging explosive before the detonation wave from the priming explosive and which has passed round the shield. This disturbs the detonation, which is propagated in a medium which is already compressed by the shock and can even stop the detonation. In less serious cases, the detonation wave has symmetry defects.

SUMMARY OF THE INVENTION

The object of the invention is to obviate these disadvantages by means of a process and apparatus for shaping a detonation wave, preventing the latter from being disturbed by the shock wave from the shield.

According to the main feature of the process according to the invention, this being of the type in which a shield is placed between the priming explosive mass and a charging explosive mass, so that the detonation wave passes round the shield, a porous material is used for forming the same and it is given a shape such that, in the charging explosive, detonation waves from the priming explosive is always in front of the shock wave of the shield. Thus, in such a material, the shock wave is propagated at a velocity which can be well below that which would be used in the same material in the compact state. Moreover, this speed is reduced in a substantially exponential manner, as a function of the path travelled from the origin of the shock in the part. However, the detonation wave propagated in the priming explosive undergoes no attenuation, so that at a given point in the charging explosive, detonation wave is always in front of the shock wave.

The invention also relates to an apparatus for performing this process. According to the main feature of this apparatus, the latter being of the type having a charging explosive mass and a priming explosive mass which are in contact with one another but separated from one another by a shield over part of their contacting surface, the shield is a mass of a porous material shaped in such a way that, in the charging explosive, the detonation wave is always in advance of the shock wave from the shield.

The apparatus according to the invention can be applied, no matter what the shape of the explosive mass, linear cylindrical with a longitudinal plane of symmetry or having a symmetry of revolution. In all cases, the shape of the shield is such that its thickness decreases on moving away from the axis of symmetry in the case of a symmetry of revolution, or from the plane of symmetry if the assembly has a linear shape, the exact shape being defined by the Expert as a function of the particular case. Moreover, use is made of a porous material such that the ratio of the density of this material to that of the same material in the compact state is between 0.2 and 0.6. Among the porous materials usable for forming the shield, it is in particular possible to use fritted metals, metal alloys or fritted metallic oxides, fritted salts, glass in the form of agglomerated balls or grains and ceramics.

Moreover, it has been found that with the apparatus according to the invention, there is a very good chronometry of the detonation wave, i.e. the passage time thereof within the charging explosive has a dispersion of approximately 50 nanoseconds. Finally, another advantage of the apparatus according to the invention is that the assembly constituted by the priming explosive and the shield has very small dimensions compared with prior art apparatuses and is in general 70% of the overall dimensions of a corresponding assembly for a conventional apparatus with equivalent performing levels.

BRIEF DESCRIPTION OF THE DRAWINGS

The invention is described in greater detail hereinafter relative to non-limitative embodiments and the attached drawings, wherein show:

FIG. 3*a* a sectional half-view of cross-section of the apparatus of FIG. 2, illustrating the propagation of waves within masses of explosive and material constituting the shield.

FIG. 3*b* a view similar to FIG. 3*a*, in the case where the shield is shaped like a biconvex lens.

DETAILED DESCRIPTION OF THE PREFERRED EMBODIMENTS

Figure 1:
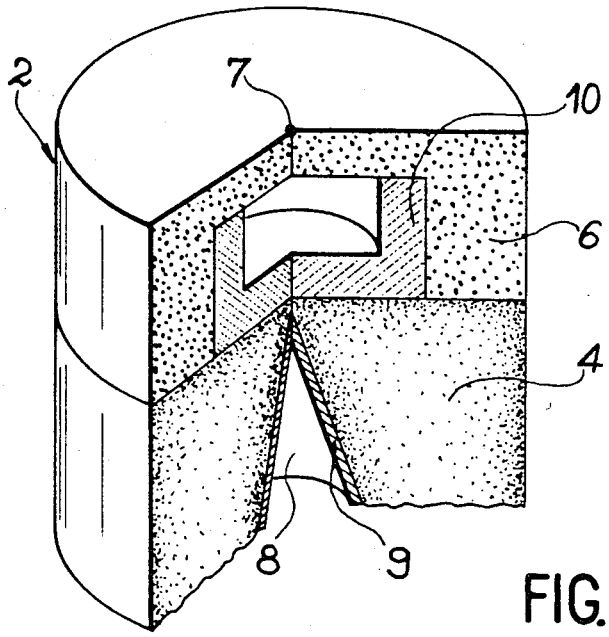
FIG. 1 a diagrammatic perspective and sectional view of an apparatus according to the prior art, in the case where the latter is cylindrical.

FIG. 1 illustrates a prior art apparatus and in this case it is cylindrical. This apparatus comprises a charging explosive mass surmounted by a priming explosive mass 6, initiation taking place at a point 7 located in the centre of the upper face of mass 6. It can be seen that the charging explosive 4 has a conical opening 8 covered by a generally metallic covering 9. As a result of this arrangement, during the explosion, the coating or covering 9 is projected in accordance with the axis of the charge and thus constitutes a dart followed by a core. This leads to a jet which is capable of considerable piercing effects, existing apparatuses making it possible to pierce sheets having thicknesses of several dozen centimetres. In order to obtain maximum efficiency, the detonation wave propagating within the charging explosive 4 must frontally attack the upper portion of covering 9, i.e. the part thereof which is closest to the priming explosive 6. For this purpose, use is made of a shield 10 separating explosive masses 4 and 6 and forcing the detonation wave from point 7 to pass round the shield before being propagated in mass 4 in the correct direction. However, shield 10 is generally made from a compact material, such as metal, ceramic or a polymer such as nylon. This leads to the formation of a shock wave, which is propagated through the shield at an extremely high velocity and enters the charging explosive 4 before the detonation wave from the priming explosive 6. As a result the shock wave compresses the useful explosive and, when the detonation wave has passed round the shield, it enters an already disturbed medium. In the least favourable case, this disturbance can stop the detonation. In other cases, this disturbance can lead to an asymmetry of the detonation wave and can consequently reduce the efficiency of the charge.

Figure 2:
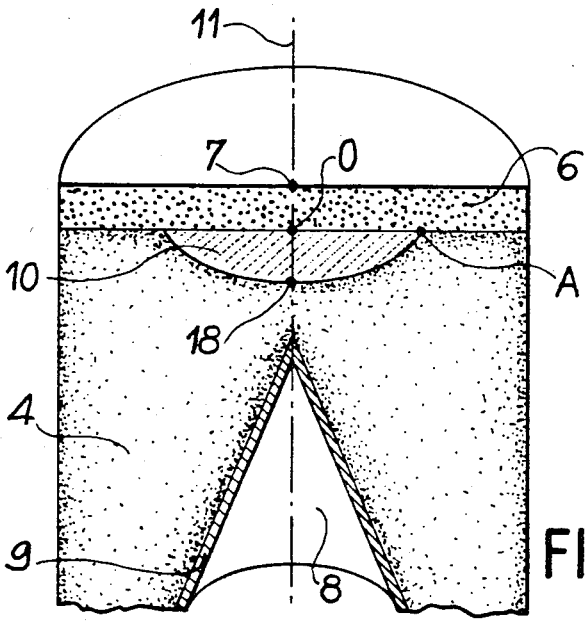
FIG. 2 a diagrammatic perspective and sectional view of an apparatus according to the in the case where the latter is cylindrical and where the contact surface between the priming explosive on the one hand and the shield and charging explosive on the other is flat.

This problem is solved by the apparatus according to the invention and illustrated in FIG. 2, also in the case of a cylindrical charge. It is obvious that it would not pass beyond the scope of the invention to modify the shape of the charge, e.g. by giving it a non-cylindrical shape, but still having a revolution of symmetry, or a linear shape with a longitudinal plane of symmetry.

FIG. 2 shows the useful explosive mass 4 and the priming explosive mass 6, charging explosive mass 4 having on the side opposite to the priming explosive mass 6 a conical cavity 8, as in the case of FIG. 1, the axis of symmetry of the assembly carrying the reference numeral 11 in FIG. 2. It can be seen that priming explosive 6 and charging explosive 4 are separated by a shield 10 over a portion of their contact surface. However, according to the invention, shield 10 is made from a porous material, e.g. fritted copper, which makes it possible to attenuate the shock wave propagated within the shield. In addition, the latter is shaped so that in the case of FIG. 2 it has a symmetry of revolution relative to axis 11. If it had a linear charge, it would be symmetrical to the plane of symmetry of the assembly. It can also be seen that its thickness decreases when moving away from axis 11, with the exact shape of the curve being defined by the Expert as a function of the particular case and particularly as a function of the materials constituting the explosive masses, the material forming the shield and the dimensions of the assembly. Thus, the shock wave produced within shield 10 is more slowly propagated than in the same material in the compact state and as a result of the fact that it is porous, there is an attenuation of the wave as a function of the distance travelled. Thus, at a given point of the explosive mass 4, the detonation wave from the priming explosive 6 is always in front of the shock wave from shield 10.

For example, on using a fritted copper block with a density equal to 0.3 times the density of the same material in the compact state (e.g. copper block obtained by casting and solidification) for producing the shield, the velocity of the initial shock wave is only 3.49 m/s in fritted copper, whereas it is 6.16 m/s in compact copper. Moreover, this velocity decreases exponentially as a function of the distance travelled as from the origin of the shock in the part.

FIG. 2 illustrates an example in which the separation surface between the priming explosive 6 on the one hand and the shield 10 and charging explosive 4 on the other is planar, the shield being substantially shaped like a plano-convex lens. However, it would not pass beyond the scope of the invention to give it a different shape, e.g. that of a biconvex lens, in the manner illustrated in FIG. 3*b*. The porous material used for forming the shield can be any random metal or fritted metal alloy (copper, stainless steel, alloys of copper, nickel, tungsten) or a fritted metal salt or an oxide, as well as glass in the form of agglomerated balls or grains, or a ceramic material.

FIG. 3*a* illustrates the propagation of waves within the different materials forming the apparatus of FIG. 2. In the case of FIGS. 2 and 3, priming takes place at point 7 located on the axis of symmetry of the assembly on the upper face of the priming explosive 6. The detonation wave 14 (FIGS. 3*a* and 3*b*) diagrammatically symbolized by continuous line circular arcs and arrows and initated from point 7, passes towards the periphery of the apparatus and then moves round the end A thereof. In shield 10, detonation wave 14 induces a shock wave 16, diagrammatically represented by broken line arcs and arrows.

On considering a point P of the contact surface between shield 10 and the charging explosive mass 4, the detonation wave from point 7 is propagated within priming explosive 6, travels the path OA and passes through arc AP before reaching point P. The shock wave propagating within the shield 10 is produced as the detonation wave travels path OA. The detonation wave passes through successive positions such as 14*a* and 14*b* corresponding to positions 16*a* and 16*b* of the shock wave. Due to the fact that shield 10 is made from a porous material, and due to the shape given to it by the Expert, the passage time of the detonation wave along path OA+AP is less than the time necessary for the shock wave 16 to reach point P. Thus, detonation wave 14 can traverse path OA, pass round point A and pass through path AP before the shock wave 16 reaches point P. When the detonation wave reaches the useful explosive 4 it propagates in a medium not disturbed by the shock wave and consequently obviates the disadvantages of the prior art.

FIG. 3*b* illustrates the propagation of waves in the same way as FIG. 3*a*, but in this case shield 10 is shaped like a biconvex lens. Priming explosive 6 then has a thin coating which is essentially shaped like a spherical cup. In all cases, the precise shape of the shield will be determined by the Expert as a function of the material constituting the shield and the dimensions of the assembly, whereby the surfaces defining the shield can be planar or curved.

FIG. 3*b* also illustrates a special realization of the invention in which the intersection point I between the detonation wave and the shock wave passes through arc A 18.

Thus, if at a given time, the detonation wave has passed round point A and is at position 14*c*, at the same time the shock wave produced in the shield when the detonation wave has travelled path OA is in position 16*c*. Waves 14*c* and 16*c* intersect at a point I. In a particular case of the invention, the Expert can define the shape of the apparatus in such a way that point I remains on arc A 18, as a function of the advance of waves 14*c* and 16*c*.

Thus, the process and apparatus according to the invention have particularly interesting advantages, the most important advantage being that it is possible to obtain a better efficiency than in the case of comparable prior art apparatuses, because the detonation wave propagates in a medium not disturbed by the shock wave. Furthermore, for equal performance levels, in the apparatus according to the invention, the assembly constituted by the shield and the priming explosive has much smaller overall dimensions than in the case of prior art apparatuses, the overall dimensions being measured between a point 7 corresponding to the initiation point on the upper surface of explosive 6 and the lower point 18 of shield 10, i.e. the point where the axis or plane of symmetry intersect shield 10 on its face opposite to the priming explosive 6. The distance between points 7 and 18 in the apparatus according to the invention is less than 70% of that in prior art apparatuses with equal performance levels. This reduction of the overall dimensions makes it possible to have a larger charging explosive mass for the same total height, which further improves the efficiency of the assembly. For example, on using an apparatus like that of FIG. 1, the height of the charge between the upper face of the priming explosive 6 and the lower face of the charging explosive 4 is 170 mm for a diameter of 100 mm, the height of the assembly constituted by shield 10 and explosive 6 being approximately 40 mm. However, in the case of the invention, it is possible to reduce this height (distance between points 7 and 18 in FIG. 3) to 26 mm only and a larger charging explosive mass can be used for the same total height. Thus, the process and apparatus according to the invention make it possible to achieve better performance levels than those of the apparatuses of the same type according to the prior art which have reduced overall dimensions.

The applications are numerous and varied and cover all fields where it is necessary to pierce or cut a metal sheet or other materials.

It is obvious that the invention is not limited to the embodiments described hereinbefore, but covers all variants thereof without passing beyond the scope of the invention. As required and as a function of each particular case, the Expert could modify the shape of the apparatus and use materials other than those referred to hereinbefore for producing the shield or can use any appropriate explosive for producing the priming and charging explosives. Finally, although the embodiments described refer to hollow charges, the invention also relates to other types of charges, which can be shaped or flat.

What is claimed is:

1. An apparatus for shaping a detonation wave comprising:

a priming explosive mass;

a charging explosive mass in contact with said priming explosive mass along a contact surface;

a shield separating said priming explosive mass and said charging explosive mass over a portion of said contact surface;

initiating means to create a detonation wave which propagates through the priming explosive mass and passes around said shield before propagating through said charging explosive mass, thus creating a shock wave which propagates through the shield before entering the charging exlosive mass;

said shield being made of a porous material and having such shape and dimensions so as to dampen the shock wave to the extent that, in the charging explosive mass, the detonation wave is always in front of the shock wave as it issues from the shield.

2. An apparatus for shaping a detonation wave comprising:

a priming explosive mass;

a charging explosive mass in contact with said priming explosive mass along a contact surface;

a shield separating said priming explosvie mass and said charging explosive mass over a portion of said contact surface;

initiating means to create a detonation wave which propagates through the priming explosive mass and passes around the shield before propagating through the charging explosive mass, thus creating a shock wave which propagates through the shield before entering the charging explosive mass;

the assembly constituted by the priming explosive mass, the shield and the charging explosive mass having a symmetry of revolution about an axis;

said shield being made of a porous material whose density is between 0.2 and 0.6 times the density of the same material in the compact state and having a thickness which decreases on moving away from the axis of symmetry, so that, in the charging explosive mass, the detonation wave is always in front of the shock wave as it issues from the shield.

3. An apparatus according to claim 1, wherein the assembly constituted by the priming explosive, the shield and the charging explosive has a symmetry of revolution about an axis.

4. An apparatus according to claim 3, wherein the shape of the shield is such that its thickness decreases on moving away from the axis of symmetry.

5. An apparatus according to claim 1, wherein the assembly constituted by the priming explosive, the shield and the charging explosive has a linear shape and is symmetrical with respect to a longitudinal plane.

6. An apparatus according to claim 5, wherein the shape of the shield is such that in any cross-section of the apparatus, its thickness decreases on moving away from the plane of symmetry.

7. An apparatus according to claim 1, wherein the ratio of the density of the porous material constituting the shield to the density of the same material in the compact state is between 0.2 and 0.6.

8. An apparatus according to claim 1, wherein the porous material constituting the shield is chosen from the group consisting of fritted metals, fritted metallic alloys, fritted metallic oxides, fritted salts, glass in the form of agglomerated balls or grains and ceramics.

9. An apparatus according to claim 2, wherein the porous material constituting the shield is chosen from the group consisting of: sintered metals, sintered metallic alloys, sintered metallic oxides, sintered salts, glass in the form of agglomerated balls or grains and ceramics.

10. An apparatus for shaping a detonation wave comprising:

a priming explosive mass;

a charging explosive mass in contact with said priming explosive mass along a contact surface;

a shield separating said priming explosive mass and said charging explosive mass over a portion of said contact surface;

initiating means to create a detonation wave which propagates through the priming explosive charge and passes around the shield before propagating through the charging explosive mass, thus creating a shock wave which propagates through the shield before entering the charging explosive mass;

the assembly constituted by the priming explosive, the shield and the charging explosive having a linear shape and being symmetrical with respect to a longitudinal plane;

said shield being made of a porous material whose density is between 0.2 and 0.6 times the density of the same material in the compact state;

the shape of said shield being such that, in any cross-section of the apparatus, its thickness decreases on moving away from the plane of symmetry, so that, in the charging explosive mass, the detonation wave is always in front of the shock wave as it issues from the shield.

11. An apparatus according to claim 10, wherein the porous material constituting the shield is chosen from the group consisting of: sintered metals, sintered metallic alloys, sintered metallic oxides, sintered salts, glass in the form of agglomerated balls or grains and ceramics.

* * * * *